US007055712B2

(12) United States Patent
Tang

(10) Patent No.: US 7,055,712 B2
(45) Date of Patent: Jun. 6, 2006

(54) DOUBLE SEAL SELF-VENTING CONTAINER

(76) Inventor: Donald C. L. Tang, 9701 Spicewood Dr., Potomac, MD (US) 20854

( * ) Notice: Subject to any disclaimer, the term of this patent is extended or adjusted under 35 U.S.C. 154(b) by 6 days.

(21) Appl. No.: 10/859,072

(22) Filed: Jun. 3, 2004

(65) Prior Publication Data

US 2005/0269319 A1 Dec. 8, 2005

(51) Int. Cl.
*B65D 6/28* (2006.01)
*B65D 8/18* (2006.01)

(52) U.S. Cl. ..... 220/4.21; 220/366.1; 220/792

(58) Field of Classification Search ..... 220/4.21, 220/4.24, 366.1, 780, 784, 792, 373, 374; 229/406

See application file for complete search history.

(56) References Cited

U.S. PATENT DOCUMENTS

| | | | | |
|---|---|---|---|---|
| 2,752,970 | A | 7/1956 | Tupper | |
| 2,816,589 | A | 12/1957 | Tupper | |
| 3,216,148 | A * | 11/1965 | Amberg | 43/55 |
| 3,307,603 | A | 3/1967 | Swett | |
| 3,511,288 | A | 5/1970 | Swett et al. | |
| 3,957,097 | A | 5/1976 | Swett | |
| 4,027,778 | A | 6/1977 | Tupper | |
| 4,466,552 | A | 8/1984 | Butterworth et al. | |
| 4,561,562 | A | 12/1985 | Trombly | |
| 4,765,506 | A | 8/1988 | Fishman et al. | |
| 5,356,026 | A | 10/1994 | Andress et al. | |
| 5,685,478 | A | 11/1997 | Tang | |
| 5,695,086 | A | 12/1997 | Viola | |
| 6,056,138 | A | 5/2000 | Chen | |
| 6,196,404 | B1 | 3/2001 | Chen | |
| D466,808 | S | 12/2002 | Liu et al. | |
| D467,497 | S | 12/2002 | Liu et al. | |
| 2002/0162846 | A1 | 11/2002 | Mercier | |
| 2003/0155353 | A1 * | 8/2003 | Tucker | 220/4.24 |
| 2003/0168465 | A1 | 9/2003 | Breimon et al. | |
| 2003/0183641 | A1 | 10/2003 | Asbury | |

* cited by examiner

*Primary Examiner*—Nathan J. Newhouse
*Assistant Examiner*—Harry Grosso
(74) *Attorney, Agent, or Firm*—Diller, Ramik & Wight

(57) ABSTRACT

A container for hot carry-out food includes a container body and a cover, each having flanges and the flanges defining a pair of seals between which is a condensation collecting chamber and radially outboard of an outermost seal is a second condensation collecting chamber which is continuously vented to atmosphere through radial venting passages or channels. Under elevated pressures, as might occur when hot food is packages in the container, the innermost seal opens permitting steam/gasses to vent into the innermost condensation collection chamber in which the steam might condense as condensate. Under higher internal container pressures, the outboardmost seal may also open and vent gasses from the innermost condensation chamber through/into the outermost condensation collection chamber and continuously from the latter to atmosphere through a plurality of continuously open circumferential spaced radial venting passages or channels.

41 Claims, 7 Drawing Sheets

DOUBLE SEAL SELF-VENTING CONTAINER

BACKGROUND OF THE INVENTION

The invention is directed to a container defined by a container body and a cover or lid which can be applied to and removed from the container body. The container is particularly adapted for use with so-called carry-out and fast-food restaurants, such as might be associated with Chinese carry-out food. Typical containers associated with fast-food/carry-out restaurants include:

| | |
|---|---|
| D466,808S | Liu et al. |
| D467,497S | Liu et al. |
| 5,685,478 | Tang |
| 6,056,138 B1 | Chen |
| 6,196,404 B1 | Chen |

The following patents and published patent applications represent the scope and content of the prior art as reflected by a search of the prior art with respect to the invention disclosed herein:

| | |
|---|---|
| US2002/0162846 Al | Mercier |
| US2003/0168465 Al | Breimon et al. |
| US2003/0183641 Al | Asbury |
| 2,275,970 | Tupper |
| 2,816,589 | Tupper |
| 3,511,288 | Swett et al. |
| 3,957,097 | Swett |
| 4,027,778 | Tupper |
| 4,466,552 | Butterworth et al. |
| 4,561,562 | Trombly |
| 4,765,506 | Fishman et al. |
| 5,356,026 | Andress et al. |
| 5,695,086 | Viola |
| 6,307,603 | Swett |

Conventional carry-out containers made from plastic material utilize a plastic cover which is snap-secured to a plastic container at peripheral edges of flanges thereof. Such flanges generally include at least one circumferential seal which prevents product spillage/leakage. If such seals fail, the product within the container will leak outwardly therefrom onto surfaces which are then soiled/damaged, such as a person's clothing, upholstery/carpeting when in transit in an automobile, etc. Such containers are stacked upon each other for home delivery from carry-out restaurants, and even if the seal between the cover and the container remains unbroken, another problem is the tendency of the sealed container to bulge under internal pressure, such as steam emanating from hot packaged products. Normally, such containers include stacking or nesting features, and if the steam is not dissipated or vented, end panels and bottom panels of the respective covers and containers bulge, the stacking features become ineffective, and containers can abruptly unstack, fall, burst open, and thereby cause damage to such surfaces as clothing, floors, automotive interiors, etc. At times, seals which unseal may not cause product spillage/leakage/damage, yet dissipate heat rapidly which in turn results in the food becoming cool and the latter in turn necessitates at-home re-heating before eating. Obviously, re-heating a food product renders it less tasty. If leakage occurs while such containers packaged with hot food are being carried in paper or plastic bags, it is not uncommon for paper bags to weaken and burst, while plastic bags collect the leakage/spillage creating a mess at the time of unpacking and serving.

BRIEF SUMMARY OF THE INVENTION

The present invention is directed to a container particularly adapted for housing hot products, such as Chinese food or the like, delivered from so-called fast-food/carry-out establishments, which will prevent spillage, provide limited and controlled venting and also retain heat through a novel multiple seal system between opposing flanges of a container body and an associated cover which are snap-secured to each other.

In further accordance with the invention, flanges of the cover and container body include a minimum of two substantially concentric peripheral seals in the form radially spaced beads and a condensate collecting channel therebetween. The flanges are also inter-lockingly secured to each other which assures that the sealing beads remain sealed at each side of the condensation collecting channel, except for controlled venting which prevents the disadvantages earlier described with respect to conventional containers used in hot food carry-out restaurants.

Preferably, the flanges of the cover and container body include a pair of radially spaced substantially concentric seals in the form of two sealing beads in opposing interengaging sealing relationship with two sealing surfaces collectively assuring the absence of product leakage and the maximization of heat retention. A condensation collection channel is formed in the flange of the container, opens upwardly toward the flange of the cover, and is located between the two sealing beads which can be located on either the cover flange, the container flange or one sealing bead on each. Under optimum conditions when a hot food product is packaged in a container and the cover is snap-secured therebetween, the two seals remain in continuous sealing contact with the opposing sealing surfaces and neither product, liquid, fluid or gas (steam, for example) will escape. However, under relatively low internal pressure created by elevated product temperatures and steam/gasses emanating therefrom, the innermost first seal will release and vent steam/gas/condensate/liquid to and into the condensation collection chamber. Thereafter, the first seal might close or remain open, depending upon internal pressure of the container. However, under higher elevated pressures, the second seal which is radially outboard of the continuous condensation collection chamber will unseal, at least briefly and temporarily, and vent further gasses (steam) to atmosphere. The latter venting radially beyond the second sealing bead is effected by a plurality of radial venting passages arranged about the periphery of the container and/or cover flanges. Each radial venting passage is defined between a pair of radially outwardly directed ribs with each pair of ribs defining therebetween a venting channel which continuously vents gasses (steam) beyond the outermost second sealing bead to atmosphere. In this manner, the container and cover remain snap-secured together under all normal conditions of packaging, transport and usage, spillage is prevented, and bulging does not occur which assures effective functioning of associated stacking/inter-nesting features of the invention.

In further keeping with the invention, the container body and cover include complementary pairs of substantially concentric stacking walls which can be interengaged so that stacked pairs of the containers remain substantially immobile when being manually carried in stacked relationship or when being transported by vehicle as is ofttimes done by way of home delivery from an associated restaurant. Preferably, the stacking walls are defined by a center circular recess which receives a boss and a depending circular bead which is received in a channel of the container body and cover. Because of the double seal self-venting features of the invention earlier described, pressure does not build up in any of the stacked containers, the covers and container bodies thereof will not bulge under pressure, and therefore stacking/inter-nesting is assured.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
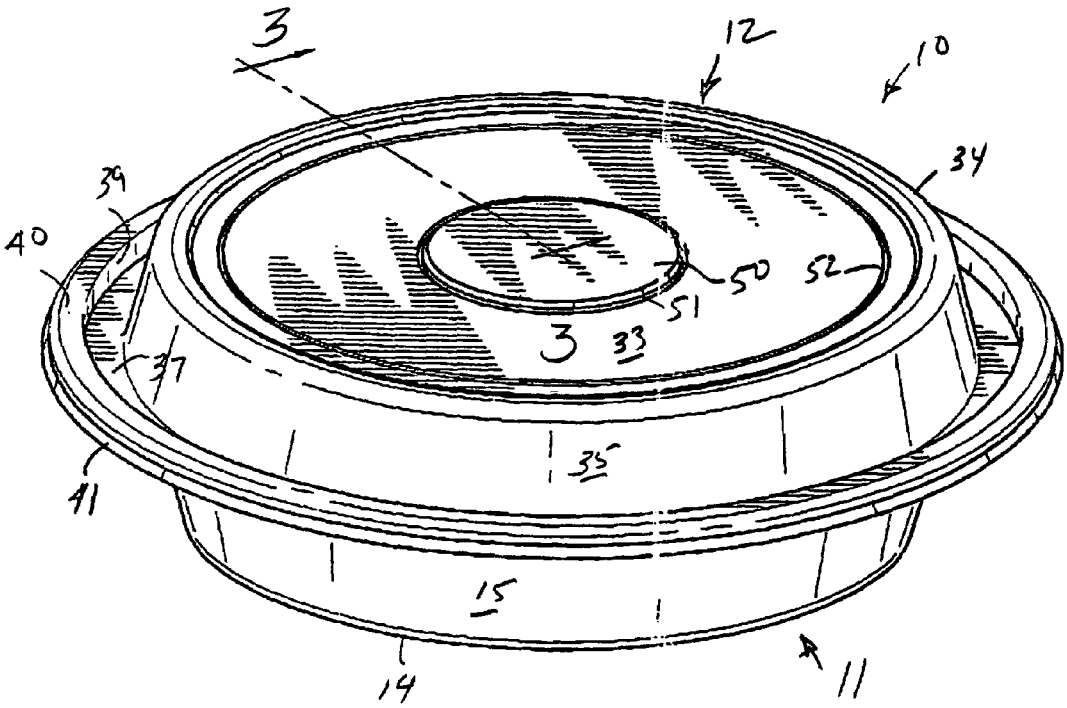
FIG. 1 is a top perspective view of a container constructed in accordance with this invention, and illustrates a cover body and a container body secured to each other along flanges thereof.
Figure 2:
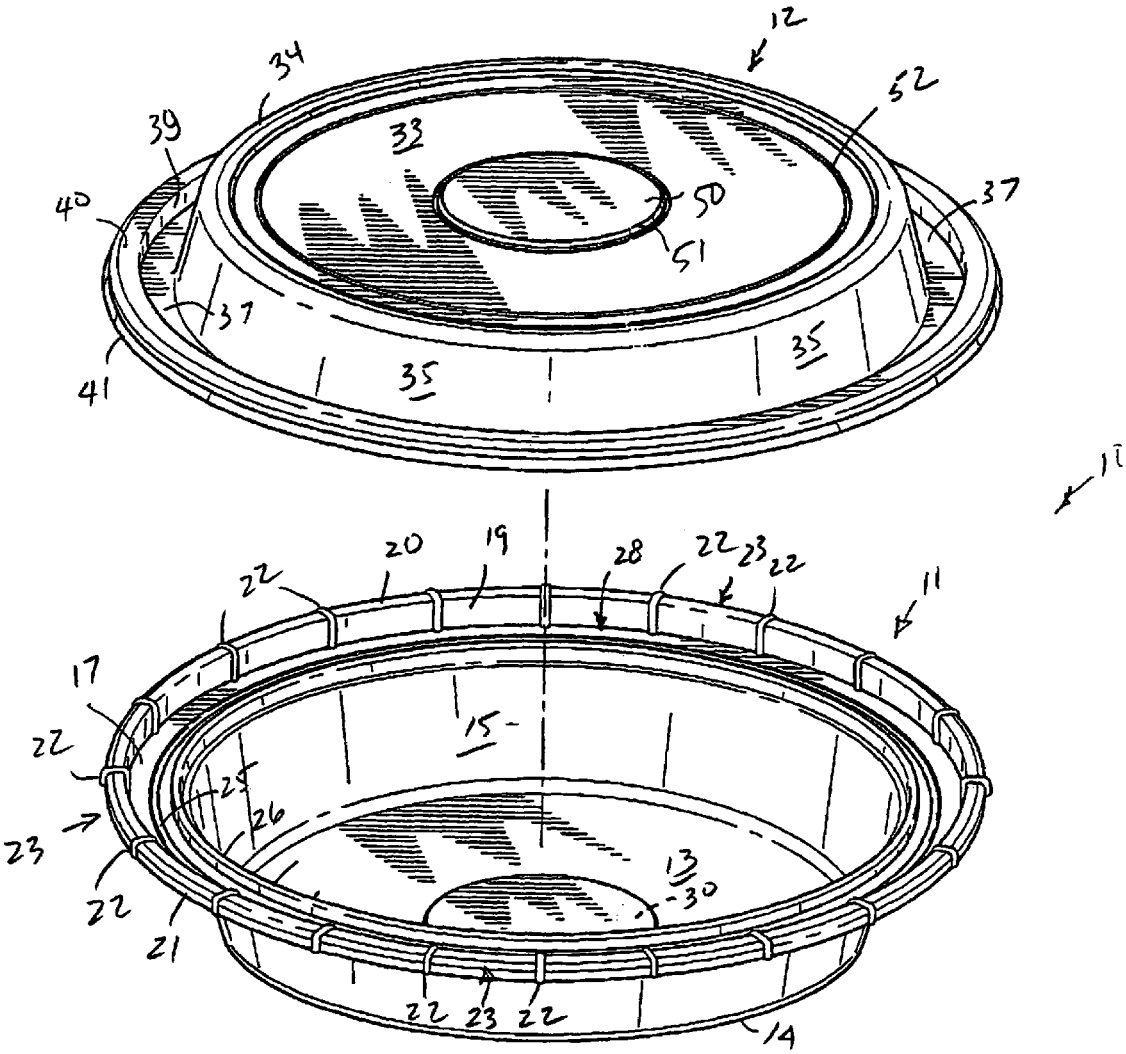
FIG. 2 is a perspective view of the container of FIG. 1, and illustrates the cover and container body disassembled with the latter including a pair of upwardly directed continuous sealing beads and a continuous condensation collection channel therebetween, and outboard of the outboard-most sealing bead a plurality of continuously open radial venting channels each defined by a pair of adjacent radially directed upstanding beads.

A novel container constructed in accordance with this invention is illustrated in FIGS. 1 through 9 of the drawings and is generally designated by the reference numeral 10.

The container 10 includes a container body 11 and a cover body, cover or lid 12 each constructed of polymeric/copolymeric synthetic plastic material.

The container body 11 includes a substantially circular bottom wall 13 terminating in a radius portion 14 which merges with a substantially upstanding cylindrical peripheral wall 15 which in turn merges with a radius portion 16. The radius portion 16 merges with a flange or annular wall portion 17 which through a radius portion 18 merges with an upstanding peripheral wall 19 radially outwardly of which projects a short annular wall 20 from which depends a downwardly directed peripheral wall or skirt 21 terminating in a terminal edge (unnumbered). The walls 19, 20, 21 include a plurality of continuous radially extending circumferentially spaced ribs 22 defining between each pair of ribs 22, 22 venting means or venting passages 23. The flange 17 includes a radially outermost continuous upwardly projecting circular sealing bead 25 which is outboard of, spaced from and concentric to a radially innermost continuous upwardly projecting substantially circular sealing bead 26. The bead 26 is substantially twice the size in height and thickness as the sealing bead 25. The substantially circular concentric sealing beads 25 and 26 cooperate to define seals between the container body 11 and the cover body or lid 12 in a manner to be described hereinafter. The concentric sealing beads 25, 26 also set-off therebetween an innermost substantially continuous condensation collection channel 27, and an outermost substantially continuous condensation collection channel 28 is defined between the sealing bead 25 and the upstanding peripheral wall 19.

The bottom wall 13 also includes stacking means in the form of a central substantially circular downwardly opening stacking recess 30 and radially outwardly therefrom concentric downwardly projecting radially spaced circular stacking beads or ribs 31, 32.

Figure 3:
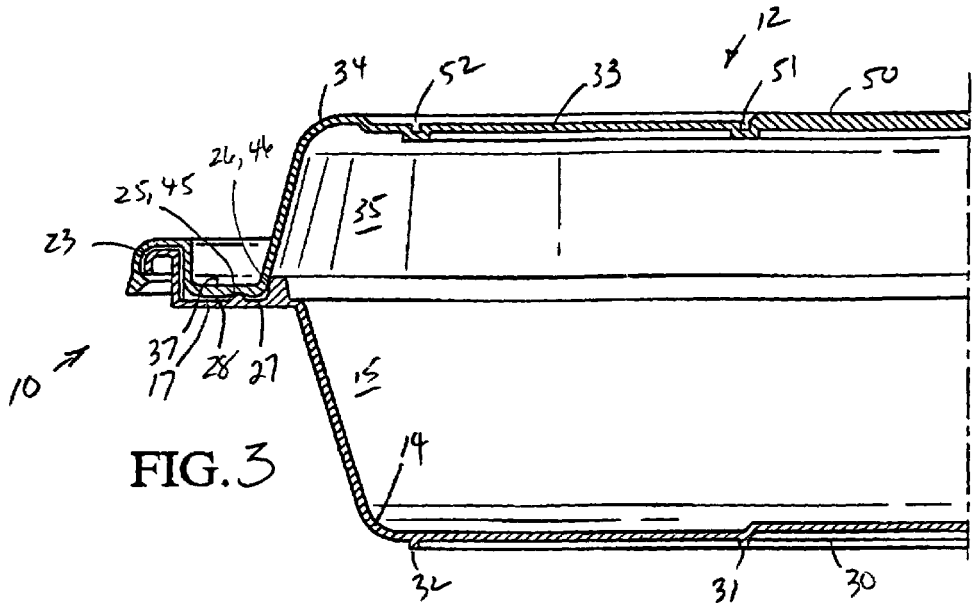
FIG. 3 is an enlarged cross-sectional view taken generally along line 3—3 of FIG. 1, and illustrates in further detail the sealing beads of the container body in sealing engagement with sealing surfaces of the cover and stacking/inter-nesting channels and ribs of the cover and the container body, respectively.
Figure 5:
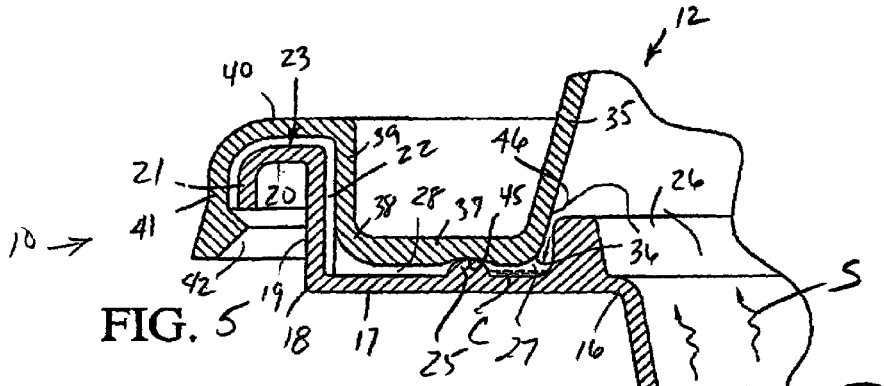
FIG. 5 is an enlarged fragmentary radial cross-sectional view taken through the assembled container of FIGS. 1 and 3, and illustrates the manner in which a heated product within the container creates steam at elevated temperatures and pressures sufficient to at least temporarily break the innermost continuous seal between the innermost sealing bead and its opposing sealing surface to vent steam/condensate into the continuous condensate collection channel which is radially outwardly sealed under modest internal container elevated pressure by the radially outermost second seal.
Figure 6:
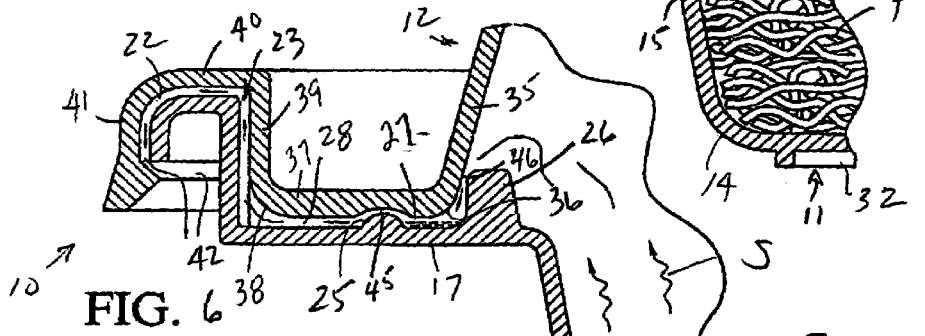
FIG. 6 is an enlarged fragmentary radial cross-sectional view similar to FIG. 5, and illustrates the second seal at least temporarily venting steam/gas to atmosphere under pressure greater than the pressure which opened the first seal of FIG. 5 and gas/steam being vented to atmosphere through the continuously open radial venting passages.

The cover body or lid 12 includes an end panel 33 merging with a radius 34 which in turn merges with a downwardly projecting tapered peripheral wall 35 united by a radius portion 36 to an annular wall or flange 37. The flange 37 merges with a radius 38 which joins to a peripheral upstanding wall 39 blending with a radially outwardly directed wall 40 which merges with a downwardly directed peripheral wall or skirt 41 having an inwardly directed continuous locking rib or nose 42. The walls 35, 37 include respective inner and outer substantially concentric radially spaced sealing surfaces 46, 45 which are in alignment with and seal against the respective sealing beads 26, 25 of the container body flange 17. The sealing surface 45 of the annular wall portion or flange 37 is in the form of a substantially continuous shallow downwardly opening recess. As shown in FIGS. 3 and 5, the interlocked relationship between the terminal edge (unnumbered) of the peripheral wall or skirt 21 of the container body 11 and the locking nose 42 of the cover body or lid 12 assures that the concentric seals 25, 45; 26, 46 are maintained in intimate interengaged sealing relationship with each other under "normal" design parameters of the container 10 when packaged with a hot product P, as is readily apparent from FIG. 3 of the drawings. Thus, when the container 10 is interlocked in its closed and sealed position (FIG. 3), the double seals 25, 45; 26, 46 prevent the leakage of product P and prevent hot contents from cooling, particularly when the container body 11 and cover 12 are constructed from polymeric/copolymeric synthetic plastic material.

The seals 25, 45 and 26, 46 are so constructed and arranged as to assure that both seals will remain in sealing contact under relatively low internal pressures caused by gasses, such as steam S (FIG. 5) emanating from the relatively hot product P. The outermost sealing rib 25 has a relatively radially broad sealing surface which is in sealing engagement with the opposing sealing surface 45 of the flange 37. However, the seal between the sealing bead 26 and the sealing surface 46 is relatively narrow because it is defined by the relatively small radius (unnumbered) of the radially outermost shoulder (unnumbered) of the sealing rib 26 which contacts the sealing surface 46 of the tapered peripheral wall 35 of the cover 12. The latter two features effectively define the inner seal 26, 46 as being appreciably weaker than the outer seal 25, 45 formed by the sealing bead 25 and the sealing surface 45. The latter difference between the weaker sealing force creating the inner seal 26, 46 and the stronger force forming the outer seal 25, 45 assures selective venting of the interior of the container 12 when packaged with hot food P, as will be more readily apparent by reference to FIG. 5.

As was noted earlier, within normal slightly elevated temperatures and pressures in the interior of the closed container 10, the seals 25, 45; 26, 46 remain sealed (FIG. 3). However, should the hot product P at elevated temperatures/pressures beyond design parameters/ranges cause elevated pressures due to the steam S, such elevated pressures beyond normal low pressure design ranges cause the weaker inboard seal 26, 46 to open (FIG. 5) and the steam S vents into and collects as condensate C in the continuous condensation collection channel 27. The condensate C will not pass radially outwardly beyond the seal 25, 45 (FIG. 5) which will not unseal or unseat under lower, though elevated, internal pressures. Thus, the condensate C will be trapped and confined in the condensation collection channel 27 and leakage/spillage is avoided.

Figure 4:
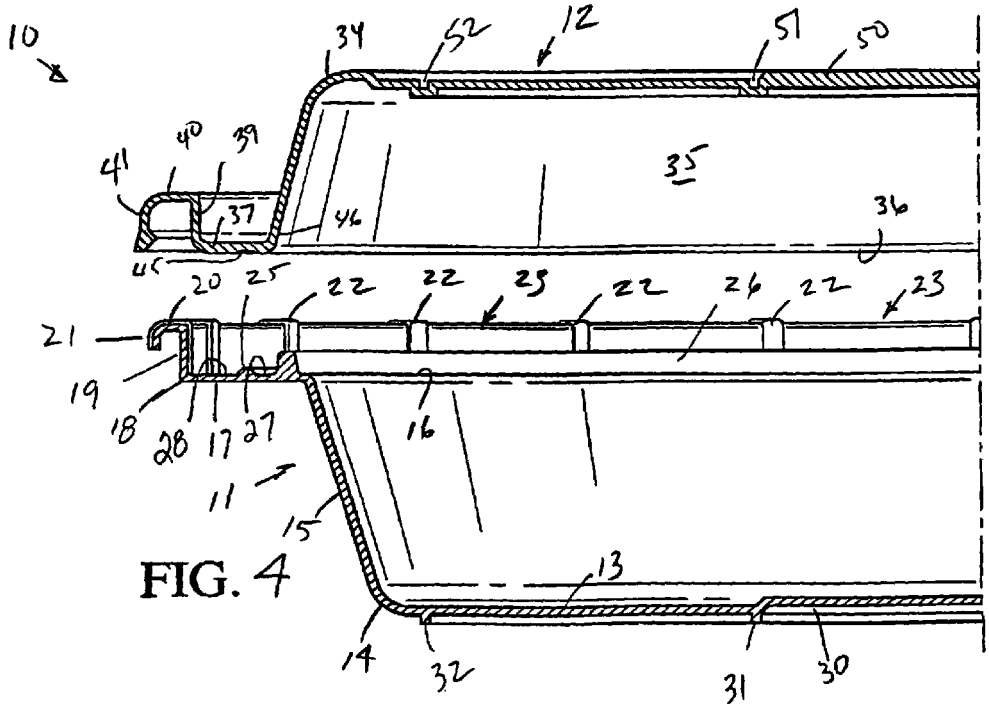
FIG. 4 is a cross-sectional view substantially identical to FIG. 3, and illustrates the cover and container body disassembled and the circumferentially spaced radial ribs between each pair of which is a continuously open relatively wide radial venting channel.
Figure 7:
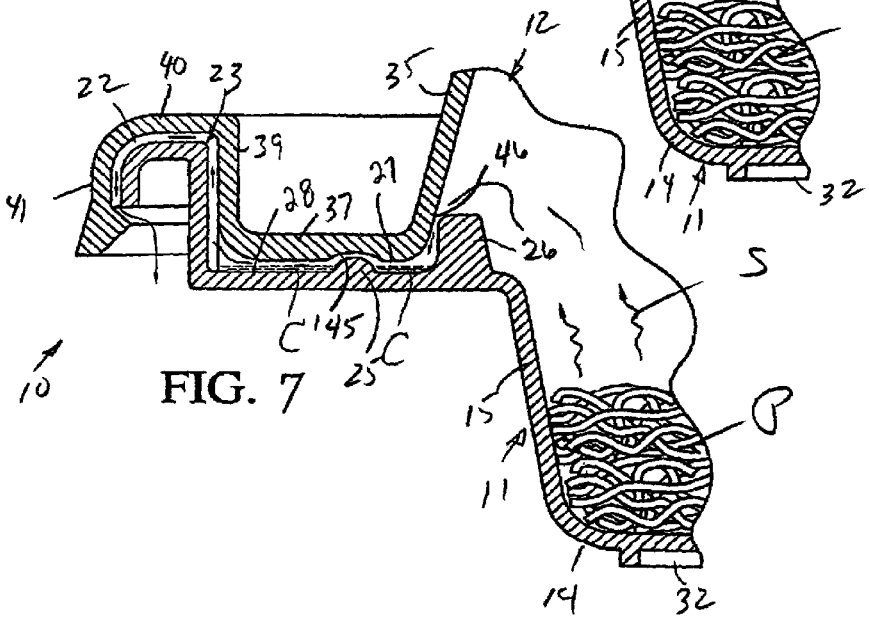
FIG. 7 is an enlarged fragmentary radial cross-sectional view similar to FIGS. 5 and 6, and illustrates additional condensate which may form in a second continuous condensation collection channel outboard of the second seal.
Figure 8:
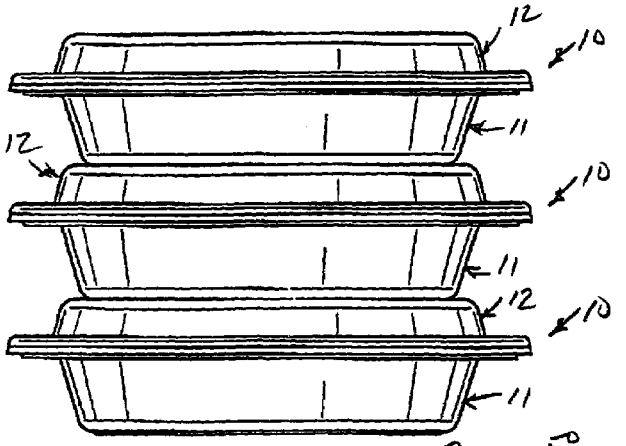
FIG. 8 is a side elevational view, and illustrates three containers in stacked/inter-nested relationship to each other.
Figure 9:
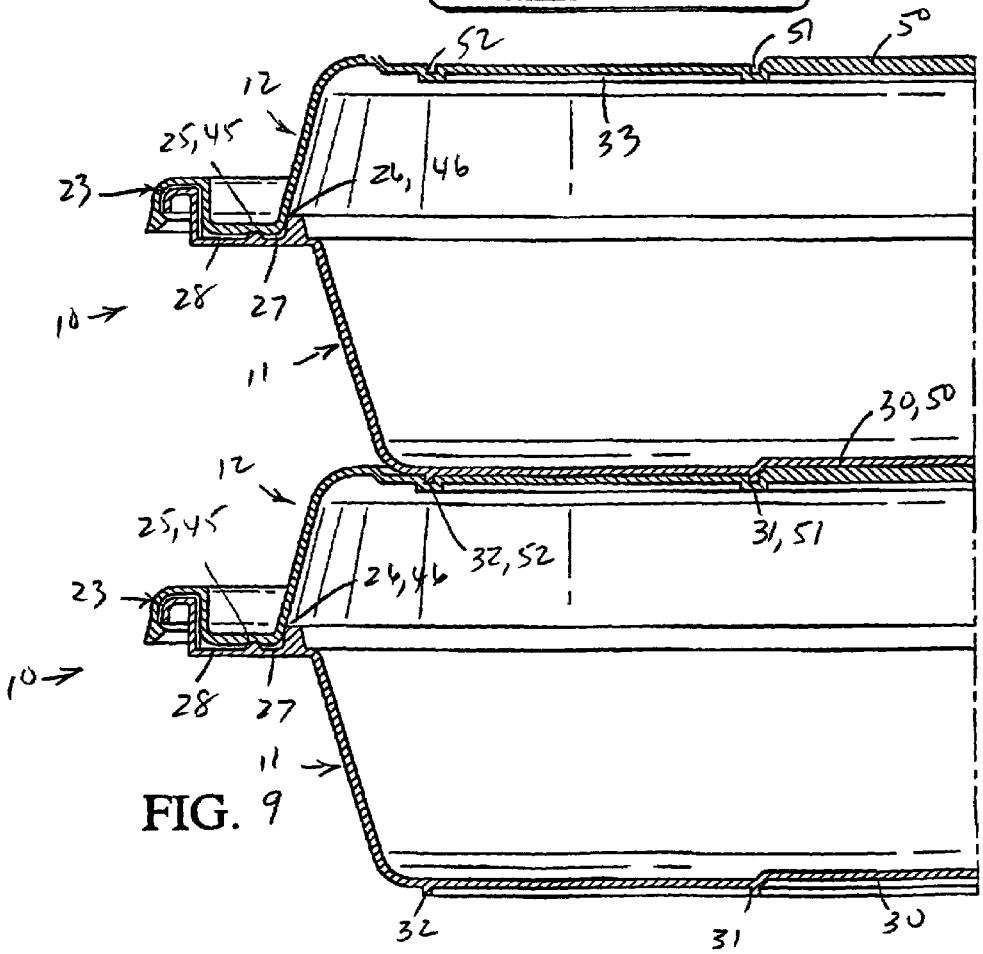
FIG. 9 is an enlarged fragmentary radial cross-sectional view through two of the containers of FIG. 8, and illustrates the manner in which concentric circular ribs/channels and a central circular projection/recess effects stacking/inter-nesting therebetween.

Should the pressure within the container 11 rise above the sealing pressure parameters of the outer seal 25, 45, the latter unseats and steam/gasses pass beyond the outer seal 25, 45 (FIG. 6) and vent to atmosphere through the radial vent passages, vent channels or vent means 23 between the ribs 22, 22 (FIGS. 4 and 7). Under certain conditions little, if any, condensate will form and collect in the second condensation chamber 28, but should the same so form, it will be collected therein as indicated by reference character C' in FIG. 7. Accordingly, the container 10 assures excellent double-sealing characteristics, yet permits selective venting to preclude product leakage/spillage.

The end panel 33 of the cover body 12 also includes a central circular upstanding or projecting locating boss or projection 50 (FIGS. 3, 4 and 9) and radially outwardly therefrom concentric radially spaced circular upwardly opening generally U-shaped locating channels 51. The locating boss 50 of the cover 12 (FIGS. 3, 8 and 9) of an underlying container 11 is housed within the locating recess 30 of a container body 11 of an overlying container 10 while at the same time locating channels 51, 52 of the cover 12 of an underlying cover 12 receive therein the circular locating ribs 31, 32 of a container body 11 of an overlying container. The latter cooperative locating or stacking means 30, 31, 32 and 50, 51, 52 assures that the containers will remain stacked and inter-nested during transport or shipment, as might be done when carried out of a restaurant and/or delivered therefrom.

Figure 10:
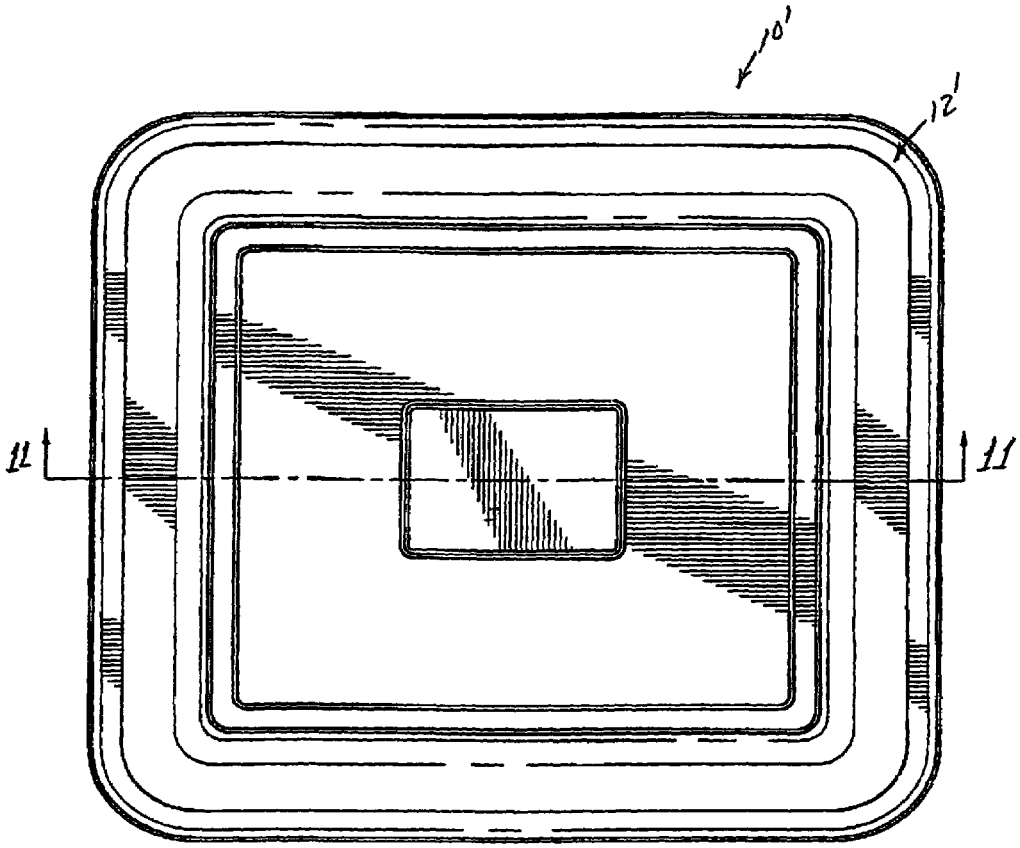
FIG. 10 is a top perspective view of another container, and illustrates a generally polygonal configuration thereof.
Figure 11:
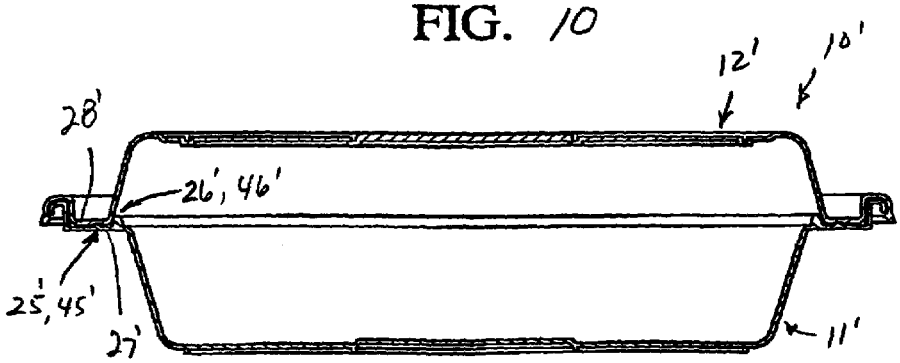
FIG. 11 is a cross-sectional view taken generally along line 11—11 of FIG. 10, and illustrates features of the container which are identical to those of FIGS. 1 through 9.

Another container constructed in accordance with this invention is illustrated in FIGS. 10 and 11 of the drawings, and like reference numerals have been primed and applied thereto to indicate identical structure corresponding to the structure of the container 10. Thus, a container 10' of FIGS. 10 and 11 is identical to the container 10 including a container body 11' and a cover or lid 12', including the cooperative double seals 25', 45'; 26', 46' thereof and concentric continuous condensation collection channels 27', 28'. The only difference between the containers 10, 10' is the configuration thereof, namely, circular versus polygonal.

Figure 12:
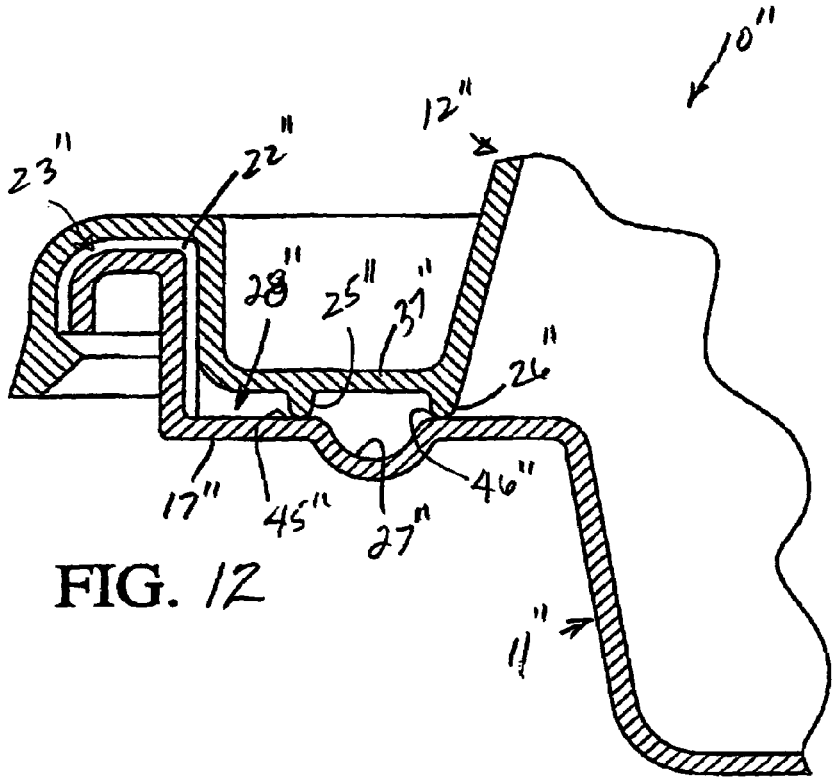
FIG. 12 is an enlarged fragmentary radial cross-sectional view similar to FIG. 5, and illustrates two downwardly projected concentric sealing beads carried by the flange of the cover sealing therebetween a condensation collection channel in a flange of the container body.
Figure 13:
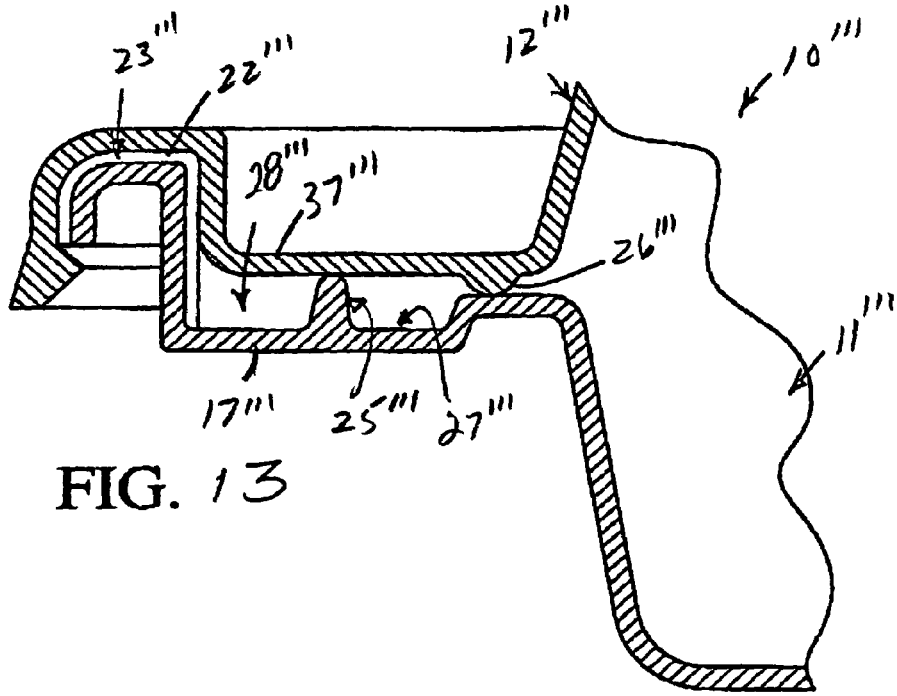
FIG. 13 is an enlarged radial fragmentary cross-sectional view similar to FIGS. 5 and 12, and illustrates two concentric sealing beads projecting respectively upwardly and downwardly from flanges of the respective container body and cover sealing therebetween a condensation collection channel in a flange of the container body.

Two additional containers 10", 10'" are illustrated respectively in FIGS. 12 and 13 and all structure identical to the container 10 has been respectively double and triple primed. The major differences between the containers 10, 10" and 10'" are the locations of the sealing beads 25", 26" and 25'", 26'" of the respective containers 10", 10'". The container 10" has the sealing beads 25", 26" projecting downwardly from the flange 37" of the cover 12" and sealing with respective sealing surfaces 45", 46" of the flange 17" of the container body 11" of the container 10". In the case of the container 10'", the sealing beads 25'", 26'" project respectively upwardly and downwardly from the respective flanges 17'", 37'" of the respective container body 11'" and cover 12'". However, in both cases each of the containers 10" and 10'" include inner and outer substantially continuous condensation collection channels 27", 28" and 27'", 28'". The seals 25", 45"; 26", 46"; and 25'", 45'"; 26'", 46'" of the respective containers 10", 10'" function in the manner heretofore described with respect to the seals 25, 45, and 26, 46, respectively, of the container 10 with respect to sealing and selective venting.

Although a preferred embodiment of the invention has been specifically illustrated and described herein, it is to be understood that minor variations may be made in the apparatus without departing from the spirit and scope of the invention, as defined by the appended claims.

What is claimed is:

1. A container comprising a container body and a cover body; each of said container body and cover body including a central wall portion, a peripheral wall portion, a flange wall portion and a terminal edge, means for defining an upwardly opening condensation collection channel of said container body flange wall portion radially outboard of said container body peripheral wall portion, first and second sealing means located on opposite sides of said condensation collection channel for defining first and second substantially continuous peripheral seals between said container body and cover body when the latter are in closed relationship to each other, said first sealing means being radially inboard of said second sealing means, and means outboard of said second sealing means for venting an area outboard of said second sealing means to atmosphere whereby any fluid media passing radially beyond said second sealing means is vented to atmosphere.

2. The container as defined in claim 1 wherein said first and second sealing means are each defined by said container body.

3. The container as defined in claim 1 wherein said first and second sealing means are each defined by said cover body.

4. The container as defined in claim 1 wherein one of said first and second sealing means is defined by one of said container body and cover body, and another of said first and second sealing means is defined by another of said container body and cover body.

5. The container as defined in claim 1 wherein said first sealing means is constructed and arranged to unseal at closed container elevated pressure to thereby vent fluid to said condensation collection channel.

6. The container as defined in claim 1 wherein said first sealing means is constructed and arranged to unseal at closed container elevated pressure to thereby vent fluid to said condensation collection channel absent unsealing of said second sealing means.

7. The container as defined in claim 1 wherein said first sealing means is constructed and arranged to unseal at closed container elevated pressure to thereby vent fluid to said condensation collection channel absent unsealing of said second sealing means, and said second sealing means is constructed and arranged to unseal at a pressure beyond said first-mentioned elevated pressure to thereby vent fluid to atmosphere through said venting means.

8. The container as defined in claim 1 including cooperative means of said cover body and container body for snap-securing the same to each other to thereby maintain said first and second sealing means in sealed relationship in the closed condition of said cover and container bodies.

9. The container as defined in claim 1 including cooperative means of said cover body and container body for snap-securing the same to each other to thereby maintain said first and second sealing means in sealed relationship in the closed condition of said cover and container bodies, and said cooperative snap-securing means is defined by a radially inwardly directed rib of said cover body flange in underlying engagement with said container body terminal edge.

10. The container as defined in claim 1 wherein said first and second substantially continuous seals and said condensation collection channel are in substantially concentric relationship to each other.

11. The container as defined in claim 1 including a first pair of radially spaced substantially concentric stacking walls of said cover body central wall portion and a first pair of radially spaced substantially concentric stacking walls of said container body central wall portion being in substantially coaxially aligned relationship with each other thereby achieving stacked relationship with substantially identically constructed containers.

12. The container as defined in claim 1 wherein said venting means includes at least one passage between said container body and cover body flange wall portions located radially outboard of said second sealing means.

13. The container as defined in claim 1 wherein said venting means includes a plurality of radially passages located in circumferentially spaced relationship between said container body and cover body flange wall portions located radially outboard of said second sealing means.

14. The container as defined in claim 1 wherein said venting means includes a plurality of radially passages located in circumferentially spaced relationship between said container body and cover body flange wall portions located radially outboard of said second sealing means, and each radial passage being defined between a pair of spaced ribs.

15. The container as defined in claim 1 wherein said venting means includes at least one passage between said container body and cover body flange wall portions located radially outboard of said second sealing means, and said at least one radial passage is formed in one of said flange wall portions.

16. The container as defined in claim 1 wherein each of said flange wall portions include a radially outermost substantially inverted U-shaped wall portion, said substantially inverted U-shaped wall portions are in nested relationship in the closed position of said cover and container bodies, and said venting means includes at least one passage between said substantially inverted U-shaped wall portions.

17. The container as defined in claim 1 wherein said first and second sealing means are each a substantially continuous upstanding respective first and second sealing bead of said cover body flange wall portion.

18. The container as defined in claim 1 wherein said first and second sealing means are each a substantially continuous upstanding respective first and second sealing bead of said cover body flange wall portion, and said first sealing bead defines said first peripheral seal by sealingly engaging against said cover body peripheral wall portion.

19. The container as defined in claim 1 including another condensation collection channel of said container body flange between said second sealing means and said venting means.

20. The container as defined in claim 2 including another condensation collection channel of said container body flange between said second sealing means and said venting means.

21. The container as defined in claim 3 including another condensation collection channel of said container body flange between said second sealing means and said venting means.

22. The container as defined in claim 4 including another condensation collection channel of said container body flange between said second sealing means and said venting means.

23. The container as defined in claim 5 including another condensation collection channel of said container body flange between said second sealing means and said venting means.

24. The container as defined in claim 6 including another condensation collection channel of said container body flange between said second sealing means and said venting means.

25. The container as defined in claim 7 including another condensation collection channel of said container body flange between said second sealing means and said venting means.

26. A container comprising a container body and a cover body; each of said container body and cover body including a central wall portion, a peripheral wall portion, a flange wall portion and a terminal edge; means for defining a first upwardly opening condensation collection channel of said container body flange wall portion radially outboard of said container body peripheral wall portion, first and second sealing means located on opposite sides of said first condensation collection channel for defining first and second substantially continuous peripheral seals between said container body and cover body when the latter are in closed relationship to each other, said first sealing means being radially inboard of said second sealing means, and means radially outboard of said second sealing means for defining a second upwardly opening condensation collection channel for collecting condensation beyond said second sealing means.

27. The container as defined in claim 26 wherein said first and second sealing means are each defined by said container body.

28. The container as defined in claim 26 wherein said first and second sealing means are each defined by said cover body.

29. The container as defined in claim 26 wherein one of said first and second sealing means is defined by one of said container body and cover body, and another of said first and second sealing means is defined by another of said container body and cover body.

30. The container as defined in claim 26 wherein said first sealing means is constructed and arranged to unseal at closed container elevated pressure to thereby vent fluid to said condensation collection channel.

31. The container as defined in claim 26 wherein said first sealing means is constructed and arranged to unseal at closed container elevated pressure to thereby vent fluid to said condensation collection channel absent unsealing of said second sealing means.

32. The container as defined in claim 26 wherein said first sealing means is constructed and arranged to unseal at closed container elevated pressure to thereby vent fluid to said condensation collection channel absent unsealing of said second sealing means, and said second sealing means is constructed and arranged to unseal at a pressure beyond said first-mentioned elevated pressure to thereby vent fluid to atmosphere through said venting means.

33. The container as defined in claim 26 including cooperative means of said cover body and container body for snap-securing the same to each other to thereby maintain said first and second sealing means in sealed relationship in the closed condition of said cover and container bodies.

34. The container as defined in claim 26 including cooperative means of said cover body and container body for snap-securing the same to each other to thereby maintain said first and second sealing means in sealed relationship in the closed condition of said cover and container bodies, and said cooperative snap-securing means is defined by a radially inwardly directed ribs of said cover body flange in underlying engagement with said container body terminal edge.

35. The container as defined in claim 26 wherein said first and second substantially continuous seals and at least one of said first and second condensation collection channels are in substantially concentric relationship to each other.

36. The container as defined in claim 26 including a first pair of radially spaced substantially concentric stacking walls of said cover body central wall portion and a first pair of radially spaced substantially concentric stacking walls of said container body central wall portion being in substantially coaxially aligned relationship with each other thereby achieving stacked relationship with substantially identically constructed containers.

37. The container as defined in claim 26 including venting means between said container body and cover body flange wall portions located radially outboard of said second sealing means for venting said first condensation collection channel.

38. The container as defined in claim 37 wherein said venting means includes a plurality of passages located in circumferentially spaced relationship between said container body and cover body flange wall.

39. The container as defined in claim 37 wherein said venting means includes a plurality of passages located in circumferentially spaced relationship between said container body and cover body flange wall portions, and each radial passage being defined between a pair of spaced ribs.

40. The container as defined in claim 37 wherein said venting means includes at least one passage between said container body and cover body flange wall portions, and said at least one radial passage is formed in one of said flange wall portions.

41. The container as defined in claim 37 wherein each of said flange wall portions include a radially outermost substantially inverted U-shaped wall portion, said substantially inverted U-shaped wall portions are in nested relationship in the closed position of said cover and container bodies, and said venting means includes at least one passage between said substantially inverted U-shaped wall portions.

* * * * *